United States Patent [19]

Tugwell

[11] 3,971,296

[45] July 27, 1976

[54] PNEUMATIC ACTUATORS

[75] Inventor: John Tugwell, Crawley, England

[73] Assignee: Kelor Limited, Burgess Hill, England

[22] Filed: Sept. 18, 1974

[21] Appl. No.: 507,105

[52] U.S. Cl. ..... 91/392; 91/186; 91/420; 91/438; 92/69 R; 92/130 R

[51] Int. Cl.[2] ..... F01B 7/06; F15B 13/042

[58] Field of Search ..... 91/186, 437, 438, 439, 91/420, 392; 92/69 R, 69 A, 69 B, 130 R

[56] References Cited

UNITED STATES PATENTS

| | | | |
|---|---|---|---|
| 666,565 | 1/1901 | Show | 92/69 A |
| 1,532,029 | 3/1925 | Bobbitt | 92/69 B |
| 1,667,559 | 4/1928 | McCaleb | 92/69 R |
| 3,476,019 | 11/1969 | Berg et al. | 91/438 |
| 3,693,501 | 9/1972 | Ward | 91/186 |
| 3,757,646 | 9/1973 | Rohner | 91/437 |

*Primary Examiner*—Paul E. Maslousky
*Attorney, Agent, or Firm*—Allison C. Collard

[57] ABSTRACT

A pneumatic actuator having a double-acting piston separating two pressure chambers, spring means to urge the piston in one direction; and valve means adapted to admit compressed air to one of the chambers and thus to load the spring means, then to transfer some of said air into the other of the chambers at a selected phase-position of said piston, and then to open the one chamber to atmosphere so that the combined forces of the spring means and of the compressed air acting on the piston in said other chamber complete the power stroke of the actuator.

3 Claims, 4 Drawing Figures

PNEUMATIC ACTUATORS

This invention relates to pneumatic actuators of the spring return variety, and to apparatus and methods for pneumatically augmenting the thrust of the springs which act upon the actuator pistons.

Although cylinder and piston type actuators are examplified herein, the terms "piston" and "cylinder" are taken to embrace those components in other forms of pneumatic actuator which fulfil the same function. For example, in a diaphragm operated actuator, the cylinder would correspond to the diaphragm housing which receives the compressed air (which word is intended to include gas), and the diaphragm to the piston.

A spring-return pneumatic actuator usually comprises a piston and cylinder in which the piston is spring-urged in one direction and pneumatically urged in the other direction, i.e. it is single acting in the pneumatic sense. Thus, when compressed air is supplied to one side of the piston, the piston is thrust to load the spring means and to provide a useful output thrust, and upon releasing the compressed air, the piston is resiliently returned while the spring means relax, with a useful but reversed output thrust. This reverse output thrust reduces linearly as the spring means relax so that the final thrust available as the piston comes to rest is considerably less than the initial return thrust.

It is this limitation of reduced final return thrust that the invention seeks to remove by pneumatic means without increasing the air consumption. Whereas it has been proposed to augment spring thrust by storing compressed air in a reservoir adjacent or attached to an actuator, wherein the stored air is supplied supplementally to the spring during the return stroke, this method increases the consumption of air. The spring means is usually in the form of a compression spring (but theoretically it could be a tension spring) so that it is convenient to refer to the "spring side" of the piston meaning that side on which a compression spring would be situated.

The invention provides for the transfer of a useful proportion of the compressed air in the cylinder from one side of the piston to the spring side thereof and then to retain the air on the spring side while releasing that on the other side. The retained air continues to expand and, together with the spring, to do work on the piston which thus provides its stroke with a thrust which is the sum of the spring thrust and thrust due to the pressure of the air on the spring side of the piston.

The apparatus whereby this method of transfer and retension of air is effected, according to the invention, comprises valve means actuated as a result of movement of the piston. The valve actuating means may comprise a stop on the piston rod which trips the valve in the case of a linear actuator, or a cam in the case of an actuator having a rotary output.

Preferably an actuator according to the invention has twin double-acting pistons working in a cylindrical bore and in opposite directions, there being three pressure chambers, i.e. one between the pistons and one on the other side of each piston, and compression springs are provided within each of the latter. Actuators of this opposed piston kind are known per se and in them, the two piston rods have racks which engage a pinion upon which the racks exert a couple.

Such an actuator, modified according to the invention, will now be described by way of example with reference to the accompanying drawings in which.

Figure 1:
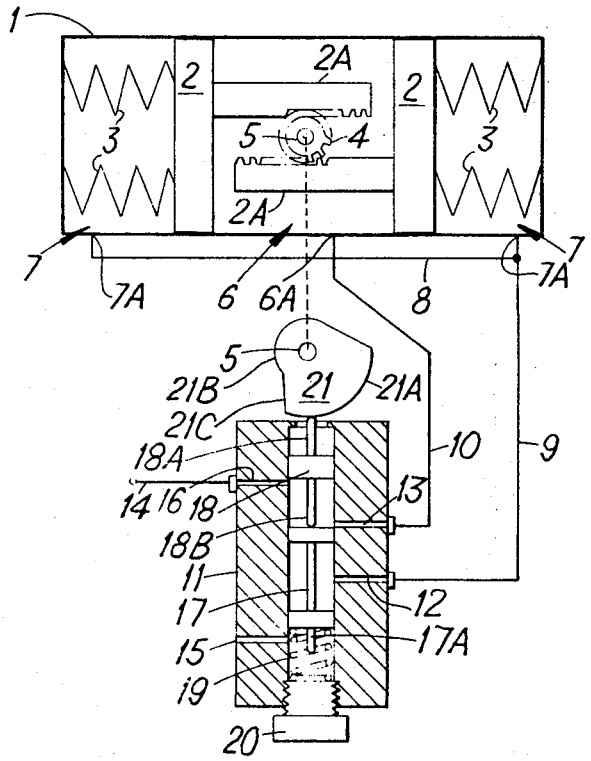
FIG. 1 illustrates an actuator of the twin piston spring return kind having a rotary output, and fitted with cam-operated valve means, in the rest (or initial) position.

Referring to FIG. 1, the actuator shown is of the twin piston kind in which the linear motion of the pistons is translated into a rotational output motion, a full stroke of the pistons of the example resulting in a 90° output rotation. A typical use of such an actuator is to operate a butterfly valve or a ball valve, both of which require a greater closing or opening torque than required for intermediate movement. The actuator to be described provides greatest torque at the beginning of the power stroke and at the end of the return stroke, and is therefore suitable for use with such valves.

The actuator comprises a cylinder 1 in which twin opposed double-acting pistons 2 slide axially towards or away from one another. Each piston has a rack piston rod 2A extending therefrom in an axial direction towards the other piston, and the rods are radially offset so that racks 2A mesh with, and on opposite sides of, a pinion 4, fixed to an output shaft 5. Movement of pistons 2 away from one another results in anticlockwise action of shaft 5, in the example through a 90° angle.

Each piston 2 is urged by compression springs 3, of which there may be one or several associated with each piston, towards the pinion 4 so that, as illustrated in FIG. 1, when compressed air is absent from the actuator, the pistons 2 adopt the position shown.

The inner pressure chamber 6, bounded by and between the two pistons 2 and cylinder 1 and therefore common to both pistons, may be supplied with compressed air or exhausted via a port diagrammatically indicated at 6A, while the two outer chambers 7, each bounded by one piston 2 and the cylinder 1, are fluidly interconnected by a conduit 8 through ports at 7A. The shaft 5 (which is diagrammatically indicated in broken lines) carries a cam 21 external to the cylinder 1. The cam is provided with two surface levels 21A and 21B, each of constant (but different) radius, and a transition surface 21C between the two. The shaft 5 extends from the cylinder 1 in which it is borne, through a pressure seal.

A valve, operatively associated with cam 21, and preferably fixedly mounted externally on the cylinder 1. The valve comprises a hollow body 11 in which are arranged ports 12, 13, 15 and 16, which may be closed, opened or interconnected by a shuttle valve element 17 and a piston element 18. Element 17 is urged by a compression spring 19 towards cam 21, the spring forces being adjustable by means of screw 20. The valve element 17 is provided with a stop 17A which contacts screw 20 when the element 17 is thrust theretowards by pneumatic pressure.

Piston element 18 is provided with two axial projections extending therefrom; 18A which is a follower of the cam 21, and oppositely, 18B which in certain valve element positions contacts element 17.

Port 12 fluidly connects with chambers 7 via a conduit 9, port 13 fluidly connects with chamber 6 via a conduit 10, port 15 is open to atmosphere and port 16 is controllably connected to a source of compressed air, or to atmosphere, via a conduit 14.

Figure 2:
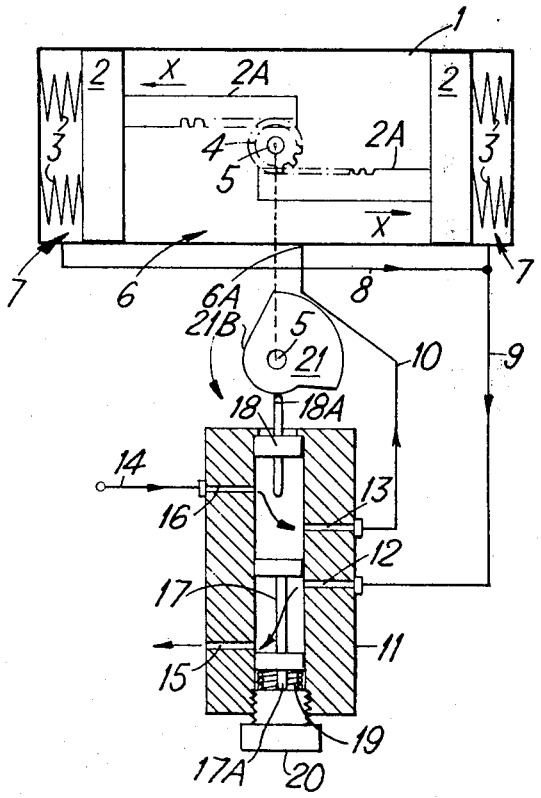
FIG. 2 shows the same actuator at the end of its power stroke.

Upon supplying compressed air to port 16, elements 17 and 18 are urged away from one another by the air pressure, thus fluidly connecting chambers 7 to atmosphere via ports 12 and 15 as shown in FIG. 2. The compressed air passes to chamber 6 via ports 16 and 13, thrusting pistons 2 apart and turning cam 21 anticlockwise through 90° to the position of FIG. 2.

Figure 3:
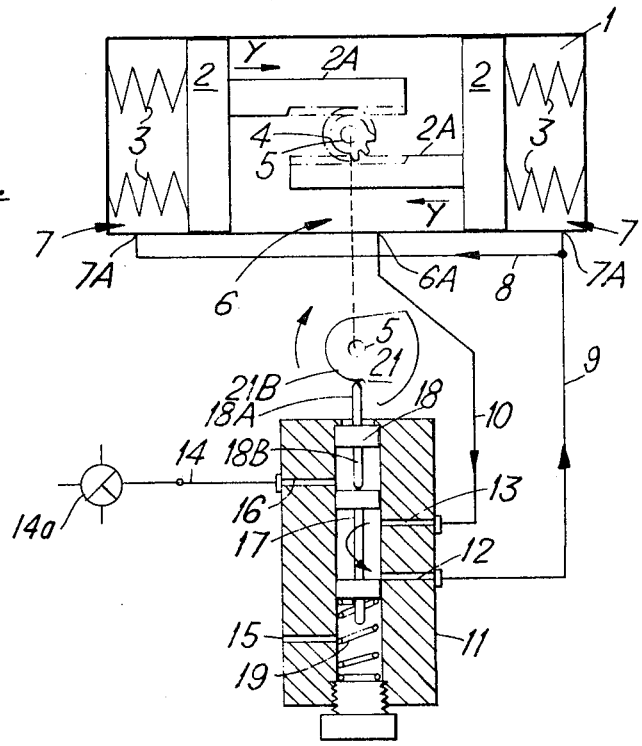
FIG. 3 shows the same actuator on its return stroke before mechanical operation of the valve.

Upon turning the compressed air OFF and opening conduit 14 to atmosphere (as may be done using a three-way solenoid valve 14*a* for example), shuttle valve element 17 is urged by spring 19 towards element 18 until it is brought to rest by contacting projection 18B thereof. FIG. 3 shows this position of shuttle element 17, and it can be seen that element 18 is also urged by element 17 and spring 19 to follow cam 21, cam-follower projection 18A then contacting cam surface 21B.

Figure 4:
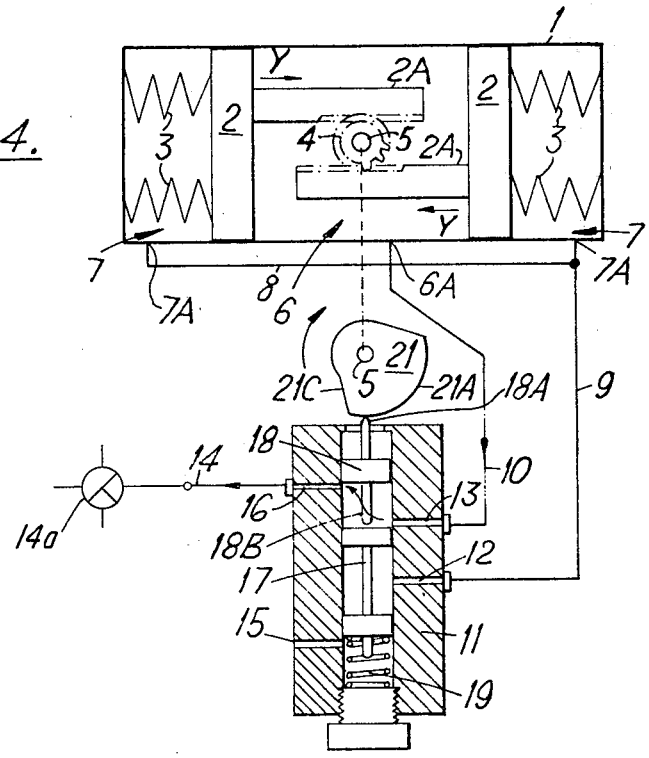
FIG. 4 shows the actuator, still on its return stroke but after mechanical operation of the valve.

Chambers 6 and 7 are now interconnected via ports 12 and 13 and shuttle element 17 as shown, and pistons 2 are urged towards one another by their springs 3. As the pistons 2 move towards one another, a phase position in their stroke is reached, which is about 60% of the stroke, where sufficient air has been transferred from chamber 6 to chamber 7; it is at this position that piston element 18 is moved by cam transistion surface 21C from surface 21B to 21A. Element 17 is moved by element 18 to adopt the position shown in FIG. 4. Chamber 6 is now exhausted to the atmosphere via ports 13, 16 and conduit 14, while port 12 is closed by element 17 thus trapping the transferred compressed air in volumes 7. This entrapped air continues to expand until pistons 2 come to rest in the positions of FIG. 1, being still subjected to the thrust of springs 3 and that due to the pressure of the entrapped air which, for example, may be between ⅜ and ½ that of the compressed air source pressure. This final pressure is governed by the point in the return stroke at which element 18 is actuated by cam 21, and by the relative volumes of 6 and 7 at beginning and end of the strokes of pistons 2.

In a variant of the device described above, it is possible to operate the change over valve by the movement of the piston guide rods instead of by the cam. For example, there may be a link connection between one or both of the guide rods and valve rod 18A, or one of the guide rods may have a cam formed upon it of which 18A is a follower.

While only a few embodiments of the present invention have been shown and described, it will be obvious that many changes and modifications may be made thereunto without departing from the spirit and scope of the invention.

What is claimed is:

1. A pneumatic actuator comprising:

a housing;

a double acting piston movably disposed in said housing separating two pressure chambers;

spring means for urging said piston in one direction;

valve means for admitting compressed air to one of said chambers for loading said spring means, and for transferring some of the air from said one chamber into the other chamber to be trapped therein when the supply of compressed air is cut off, and for opening said one chamber to atmosphere, said spring means and the trapped compressed air providing combined forces acting on said piston in said other chamber completing a power stroke of the actuator; and means for mechanically interconnecting said piston with said valve means for opening said one chamber to atmosphere at a selected phase position of said piston.

2. The actuator according to claim 1 wherein said actuator includes a rotatable output shaft, a cam rotatably mounted to said output shaft, said cam mechanically interconnects said valve means with said piston.

3. The actuator according to claim 2 wherein said valve means comprises a resiliently loaded spool and a piston slidable separately from the spool, said valve piston includes a cam follower part, all such that actuation of the actuator causes movement of the valve piston in one direction while compressed air and the spool cause movement of the valve piston in the other direction.

* * * * *